US005989456A

United States Patent [19]

Tsuzaki

[11] Patent Number: 5,989,456

[45] Date of Patent: Nov. 23, 1999

[54] SOLVENT COMPOSITION

[75] Inventor: Masaaki Tsuzaki, Ichihara, Japan

[73] Assignee: Asahi Glass Company Ltd., Tokyo, Japan

[21] Appl. No.: 09/120,878

[22] Filed: Jul. 23, 1998

[30] Foreign Application Priority Data

Jul. 24, 1997 [JP] Japan ..... 9-198914

[51] Int. Cl.[6] ..... C11D 7/50; C11D 7/26; C23G 5/028; B08B 3/08; B01F 1/00

[52] U.S. Cl. ..... 252/364; 510/166; 510/174; 510/175; 510/243; 510/245; 510/273; 510/411; 510/412; 134/40

[58] Field of Search ..... 252/364, 2, 8, 252/67; 510/164, 166, 170, 174, 175, 188, 204, 208, 219, 243, 245, 273, 412, 411; 134/40

[56] References Cited

U.S. PATENT DOCUMENTS

| | | | |
|---|---|---|---|
| 5,102,469 | 4/1992 | Buchwald et al. | 134/22.14 |
| 5,116,426 | 5/1992 | Asano et al. | 134/40 |
| 5,135,676 | 8/1992 | Buchwald et al. | 134/12 |
| 5,320,683 | 6/1994 | Samejima et al. | 134/40 |
| 5,607,912 | 3/1997 | Samejima et al. | 510/411 |
| 5,827,812 | 10/1998 | Flynn et al. | 510/411 |

*Primary Examiner*—Joseph D. Anthony
*Attorney, Agent, or Firm*—Oblon, Spivak, McClelland, Maier & Nuestadt, P.C.

[57] ABSTRACT

A solvent composition comprising dichloropentafluoropropane and (perfluorobutyl) methyl ether, wherein the ratios of the dichloropentafluoropropane and the (perfluorobutyl) methyl ether in the solvent composition are from 10 to 50 wt % and from 50 to 90 wt %, respectively.

10 Claims, No Drawings

SOLVENT COMPOSITION

BACKGROUND OF THE INVENTION

1. Field of the Invention

The present invention relates to solvent composition comprising dichloropentafluoropropane and (perfluorobutyl) methyl ether.

2. Discussion of Background

Dichloropentafluoropropane (hereinafter referred to simply as R225), 1,1-dichloro-1-fluoroethane (hereinafter referred to simply as R141b), or a solvent mixture composition of R225 or R141b with a solvent soluble therein, which is excellent in non-flammability, low toxicity and stability, has been widely used for various degreasing, defluxing or dust removal, or as a dewatering solvent, a dry cleaning solvent, a solvent for chemical reaction, a carrier solvent for silicone and halogenated lubricants or the like. Further, (perfluorobutyl) methyl ether has been developed and is being marketed.

R225 or a solvent mixture composition of R225 with a solvent soluble in R225, is used for various degreasing and defluxing. However, R225 adversely affects an acrylic resin, and could not be used for cleaning a part containing this resin.

(Perfluorobutyl) methyl ether scarcely affects a resin, but its solvency of e.g. oil is poor, whereby the cleaning ability tends to be inadequate, and no adequate cleaning effects can be obtained.

WO-96/36689 discloses an azeotropic composition comprising from 61 to 90 wt % of R225 and from 10 to 39 wt % of (perfluorobutyl) methyl ether. However, this composition was found to be ineffective for overcoming the adverse effect of R225 against the acrylic resin.

SUMMARY OF THE INVENTION

It is an object of the present invention to provide a solvent composition comprising R225 and (perfluorobutyl) methyl ether, whereby the adverse effect to an acrylic resin can be overcome, while maintaining the solvency of e.g. oil, which is an excellent characteristic of R225.

The present invention provides a solvent composition comprising dichloropentafluoropropane and (perfluorobutyl) methyl ether, wherein the ratios of the dichloropentafluoropropane and the (perfluorobutyl) methyl ether in the solvent composition are from 10 to 50 wt % and from 50 to 90 wt %, respectively.

DETAILED DESCRIPTION OF THE PREFERRED EMBODIMENTS

In the present invention, R225 means at least one member selected from a group of isomers of dichloropentafluoropropane represented by the chemical formula $C_3HCl_2F_5$. R225 is preferably at least one member selected from the group consisting of 3,3-dichloro-1,1,1,2,2-pentafluoropropane (hereinafter referred to simply as R225ca) and 1,2-dichloro-1,1,2,2,3-pentafluoropropane (hereinafter referred to simply as R225cb).

Particularly preferred R225 is a mixture of R225ca and R225cb. The mixing ratio is preferably R225ca/R225 cb=1 to 99 wt %/1 to 99 wt %, more preferably R225ca/R225cb=5 to 75 wt %/25 to 95 wt %.

In the present invention, (perfluorobutyl) methyl ether means at least one member selected from a group of compounds represented by the chemical formula $C_4F_9$-O-$CH_3$.

(Perfluorobutyl) methyl ether is preferably at least one member selected from the group consisting of (perfluoro-n-butyl) methyl ether and (perfluoroisobutyl) methyl ether.

Particularly preferred (perfluorobutyl) methyl ether is a mixture comprising (perfluoro-n-butyl) methyl ether and (perfluoroisobutyl) methyl ether. The mixing ratio is preferably (perfluoro-n-butyl) methyl ether/(perfluoroisobutyl) methyl ether=10 to 80 wt %/20 to 90 wt %, more preferably (perfluoro-n-butyl) methyl ether/(perfluoroisobutyl) methyl ether=20 to 60 wt %/40 to 80 wt %.

The solvent composition of the present invention comprises R225 and (perfluorobutyl) methyl ether, and their ratios in the solvent composition are from 10 to 50 wt %, and from 50 to 90 wt %, respectively. If the mixing ratio of R225 is less than 10 wt %, the solvency of oil and fat tends to be remarkably low, and such is not suitable for application to e.g. a cleaning solvent. If the mixing ratio of R225 exceeds 50 wt %, an adverse effect to a thermoplastic acrylic resin such as an acrylic resin, particularly a methyl methacrylate resin, tends to be substantial, whereby the applicable range tends to be restricted, as there will be a material which can not be compatible with such a composition.

The solvent composition of the present invention may contain a compound other than the above R225 and (perfluorobutyl) methyl ether within a range not to affect the purpose of the present invention.

To adjust mainly the solvency, it is preferred, for example, to add at least one of the following compounds in an amount of at most 40 wt % to the composition of the present invention. More preferably, the amount is from 0.1 to 30 wt %, and most preferably, the amount is from 0.1 to 20 wt %.

Hydrocarbons including, for example, n-pentane, 2,2-dimethylpropane, n-hexane, 2-methylpentane, 3-methylpentane, 2,2-dimethylbutane, 2,3-dimethylbutane, n-heptane, 2-methylhexane, 3-methylhexane, 2,3-dimethylpentane, 2,4-dimethylpentane, n-octane, 2,2,3-trimethylpentane, 2,2,4-trimethylpentane, cyclopentane, cyclohexane, methylcyclohexane and ethylcyclohexane.

Chlorinated hydrocarbons, such as dichloromethane, cis-1,2-dichloroethylene, trans-1,2-dichloroethylene, trichloroethylene and tetrachloroethylene.

Brominated hydrocarbons such as 1-bromopropane, and 2-bromopropane.

Ketones such as acetone, methyl ethyl ketone, methyl butyl ketone and methyl isobutyl ketone.

Ethers such as diethyl ether, methyl cellosolve, tetrahydrofuran and 1,4-dioxane.

Hydrochlorofluorocarbons such as 2,2-dichloro-1,1,1-trifluoroethane and 1,1-dichloro-1-fluoroethane.

Esters such as methyl acetate, ethyl acetate, propyl acetate and butyl acetate.

Alcohols such as methanol, ethanol, 1-propanol, 2-propanol, 1-butanol, 2-butanol, isobutanol or t-butanol.

In order to increase primarily the stability, it is preferred to add, for example, at least one of the following compounds in a proportion of at most 5 wt % to the composition of the present invention. A more preferred ratio is from 0.001 to 5 wt %.

Nitro compounds such as nitromethane, nitroethane, nitropropane and nitrobenzene.

Amines such as diethylamine, triethylamine, isopropylamine and n-butylamine.

Phenols such as phenol, o-cresol, m-cresol, p-cresol, thymol, p-t-butylphenol, t-butylcatechol, catechol, isoeugenol, o-methoxyphenol, bisphenol A, isoamyl salicylate, benzyl salicylate, methyl salicylate and 2,6-di-t-butyl-p-cresol.

Triazoles such as 2-(2-hydroxy-5-methylphenyl) benzotriazole, 2-(2-hydroxy-3-t-butyl-5-methylpheny)-5-chlorobenzotriazole, 1,2,3-benzotriazole and 1-[(N,N-bis-2-ethylhexyl) a minomethyl]benzotriazole.

The solvent composition of the present invention comprises R225 and (perfluorobutyl) methyl ether in the specific ratio, and thus, it is excellent without an adverse effect to the material of the article to be cleaned, for example, plastics or rubbers, such as a plasticized polyvinyl chloride resin, a polystyrene, a polycarbonate, a polyphenylene oxide, an ABS resin, an acrylic resin or EPDM rubber, and yet without inflammability.

Further, the solvent composition of the present invention has a solvency of the same level as the conventional R225 and can suitably be employed for various applications. Specific applications include, for example, a cleaning agent for removing a soil such as grease, oil, flux, wax, ink or dust, a dewatering agent for removing water attached to a solid surface, a solvent for chemical reaction such as polymerization, a carrier solvent for various chemical substances, a solvent for extraction, a solvent for coating, a solvent for dry cleaning. It is particularly useful as a cleaning agent for removing a soil derived from a lubricant or a releasing agent.

The material of an article to which the above cleaning agent or dewatering agent is applicable, may, for example, be glass, ceramics, plastics, rubbers or metals, and the types of the article may, for example, be IC parts, electric appliances, precision machines, or optical lenses. As the cleaning method, hand wiping, dipping, spraying, agitation, ultrasonic cleaning, vapor cleaning or a combination thereof, may, for example, be employed.

Now, the present invention will be described in further detail with reference to Examples. However, it should be understood that the present invention is by no means restricted to such specific Examples.

Table 1 shows the ratios (unit: wt %) of ca (R225ca), cb (R225cb), nB ((perfluoro-n-butyl) methyl ether) and iB ((perfluoroisobutyl) methyl ether) in the solvent compositions of Working Examples (Examples 1 to 9) and Comparative Examples (Examples 10 to 18).

Test for Cleaning Metal Processing Oil (first best)

A test for cleaning metal processing oil was carried out using the solvent compositions as identified in Table 1. Namely, a test coupon (25 mm×30 mm×3 mm) of polymethyl methacrylate was immersed in Houghton H-3105 Drawing Compound, metal processing oil, manufactured by Nippon Houghton K.K. After the immersing, the test coupon was taken out and immersed for 10 minutes in the boiling solvent composition as identified in Table 1. After the immersing, the test coupon was visually inspected, and the change in the appearance (◎: no change, ×: cracking or partial dissolution observed) was evaluated, and the results are shown in column A in Table 1.

Test for Cleaning Metal Processing Oil (second test)

A test for cleaning metal processing oil was carried out by using the solvent compositions as identified in Table 1. Namely, test coupons (25 mm×30 mm×2 mm) of SS-304 were, respectively, immersed in metal processing oils, Houghton H-3105 Drawing Compound, manufactured by Nippon Houghton K.K. (column B), Dafunicut AS40H, manufactured by Idemitsu Kosan K.K. (column C), Dafunicut AS30D, manufactured by Idemitsu Kosan K.K. (column D) and Dafunicut AS25F, manufactured by Idemitsu Kosan K.K. (column E). After immersing, the test coupons were taken out and immersed for 5 minutes in the solvent compositions as identified in Table 1, which were kept at 40° C. The removal of the processing oils (◎: excellently removed, ×: slightly remained, Δ: substantially remained) was evaluated, and the results are shown in columns B to E in Table 1.

TABLE 1

| Ex. | ca | cb | nB | iB | A | B | C | D | E |
|---|---|---|---|---|---|---|---|---|---|
| 1 | 0 | 50 | 0 | 50 | ◎ | ◎ | ◎ | ◎ | ◎ |
| 2 | 50 | 0 | 17.5 | 32.5 | ◎ | ◎ | ◎ | ◎ | ◎ |
| 3 | 25 | 25 | 17.5 | 32.5 | ◎ | ◎ | ◎ | ◎ | ◎ |
| 4 | 24 | 16 | 60 | 0 | ◎ | ◎ | ◎ | ◎ | ◎ |
| 5 | 15 | 15 | 24.5 | 45.5 | ◎ | ◎ | ◎ | ◎ | ◎ |
| 6 | 8 | 12 | 28 | 52 | ◎ | ◎ | ◎ | ◎ | ◎ |
| 7 | 0 | 10 | 31.5 | 58.5 | ◎ | ◎ | ◎ | ◎ | ◎ |
| 8 | 10 | 0 | 31.5 | 58.5 | ◎ | ◎ | ◎ | ◎ | ◎ |
| 9 | 5 | 5 | 31.5 | 58.5 | ◎ | ◎ | ◎ | ◎ | ◎ |
| 10 | 0 | 55 | 15.8 | 29.2 | X | | | | |
| 11 | 55 | 0 | 15.8 | 29.2 | X | | | | |
| 12 | 27.5 | 27.5 | 15.8 | 29.2 | X | | | | |
| 13 | 0 | 92 | 0 | 8 | | Δ | Δ | X | Δ |
| 14 | 92 | 0 | 2.8 | 5.2 | | Δ | Δ | X | Δ |
| 15 | 46 | 46 | 2.8 | 5.2 | | Δ | Δ | X | Δ |
| 16 | 0 | 95 | 1.8 | 3.2 | | X | X | X | X |
| 17 | 95 | 0 | 1.8 | 3.2 | | X | X | X | X |
| 18 | 47.5 | 47.5 | 1.8 | 3.2 | | X | X | X | X |

The solvent composition of the present invention satisfies the excellent characteristics which conventional 1,1,2-trichloro-1,2,2-trifluoroethane and 1,1,1-trichloroethane have, and further has merits that it can be avoided from an adverse effect on the material of an article to be cleaned, and it has substantially no adverse effect on the ozone layer.

What is claimed is:

1. A solvent composition comprising dichloropentafluoropropane and (perfluorobutyl) methyl ether, wherein the ratios of the dichloropentafluoropropane and the (perfluorobutyl) methyl ether in the solvent composition are from 10 to 50 wt % and from 50 to 90 wt %, respectively.

2. The solvent composition according to claim 1, wherein the dichloropentafluoropropane is at least one member selected from the group consisting of 3,3-dichloro-1,1,1,2,2,-pentafluoropropane and 1,3-dichloro-1,1,2,2,3-pentafluoropropane.

3. The solvent composition according to claim 1, wherein the dichloropentafluoropropane is a mixture which consists of from 1 to 99 wt % of 3,3-dichloro-1,1,1,2,2-pentafluoropropane and from 1 to 99 wt % of 1,3-dichloro-1,1,2,2,3-pentafluoropropane.

4. The solvent composition according to claim 1, wherein the dichloropentafluoropropane is a mixture which consists of from 5 to 75 wt % of 3,3-dichloro-1,1,1,2,2-pentafluoroprorpane and from 25 to 95 wt % of 1,3-dichloro-1,1,2,2,3-pentafluoropropane.

5. The solvent composition according to claim 1, wherein the (perfluorobutyl) methyl ether is at least 1 member selected from the group consisting of (perfluoro-n-butyl) methyl ether and (perfluoroisobutyl) methyl ether.

6. The solvent composition according to claim 5, wherein the (perfluorobutyl) methyl ether is a mixture of (perfluoro-n-butyl) methyl ether and (perfluoroisobutyl) methyl ether.

7. The solvent composition according to claim 5, wherein the (perfluorobutyl) methyl ether is a mixture which consists of from 10 to 80 wt % of (perfluoro-n-butyl) methyl ether and from 20 to 90 wt % of (perfluoroisobutyl) methyl ether.

8. A method for removing a soil or water from a surface of an article, by means of the solvent composition as defined in claim 1.

9. The method according to claim 8, wherein the soil is one derived from a lubricant or a releasing agent.

10. The method according to claim 8, wherein the article is made of a plasticized polyvinyl chloride resin, a polystyrene, a polycarbonate, a polyphenylene oxide, an ABS resin, an acrylic resin or EPDM rubber.

* * * * *